United States Patent [19]

Gregory

[11] 3,965,542

[45] June 29, 1976

[54] LATCH-EQUIPPED, SHE-BOLT GRIPPER DEVICE FOR A CONCRETE WALL FROM TIE ROD

[75] Inventor: R. Kirk Gregory, Barrington, Ill.

[73] Assignee: Symons Corporation, Des Plaines, Ill.

[22] Filed: Jan. 27, 1975

[21] Appl. No.: 544,330

[52] U.S. Cl. ..... 24/136 R; 52/223 L; 249/40; 249/219 R; 254/29 A; 425/111

[51] Int. Cl.[2] ..... E04G 17/08; F16G 11/04

[58] Field of Search ..... 249/188, 219 R, 190, 249/191, 213, 214; 425/111; 24/136 R, 155 BR, 263 C, 263 CA, 263 SC, 221 R, 221 K; 52/223 L; 222/340, 341, 383, 384

[56] References Cited

UNITED STATES PATENTS

| | | | |
|---|---|---|---|
| 2,717,724 | 9/1955 | Martin | 222/384 X |
| 3,910,546 | 10/1975 | Connors | 249/40 |

*Primary Examiner*—Francis S. Husar
*Assistant Examiner*—John S. Brown
*Attorney, Agent, or Firm*—Norman H. Gerlach

[57] ABSTRACT

A releasable, reusable, slip-on she-bolt type gripper device designed for telescopic reception therein of one end of a cylindrical horizontally extending tie rod which is associated with a concrete wall form and serves to lateral displacement of the sides of the form when the latter is in use. The device is adapted to receive the reaction pull of the tie rod when the latter is under tension as a result of the pouring of wet concrete between the form sides. Longitudinally shiftable, chuck-forming jaw segments within the forward or inner frusto-conical end section of an elongated tubular shell are spring-biased so as frictionally to engage the adjacent end of the associated tie rod and are self-energized by the longitudinal pull of the latter. A pull rod is connected in common to all of the jaw segments, projects rearwardly through the rear or outer end of the shell and, when pulled rearwardly, releases the jaw segments from the tie rod. A flat spank near the rear end of the pull rod, when aligned with a retention slot in the outer end wall of the shell is capable of being pulled through such slot so that when the pull rod is rotated through an angle of 90° and then released, the flat spank and slot cooperate to maintain the chuck jaw segments released from the tie rod until the pull rod is rotated to realign the spank and slot and then released.

6 Claims, 4 Drawing Figures

FIG. 3
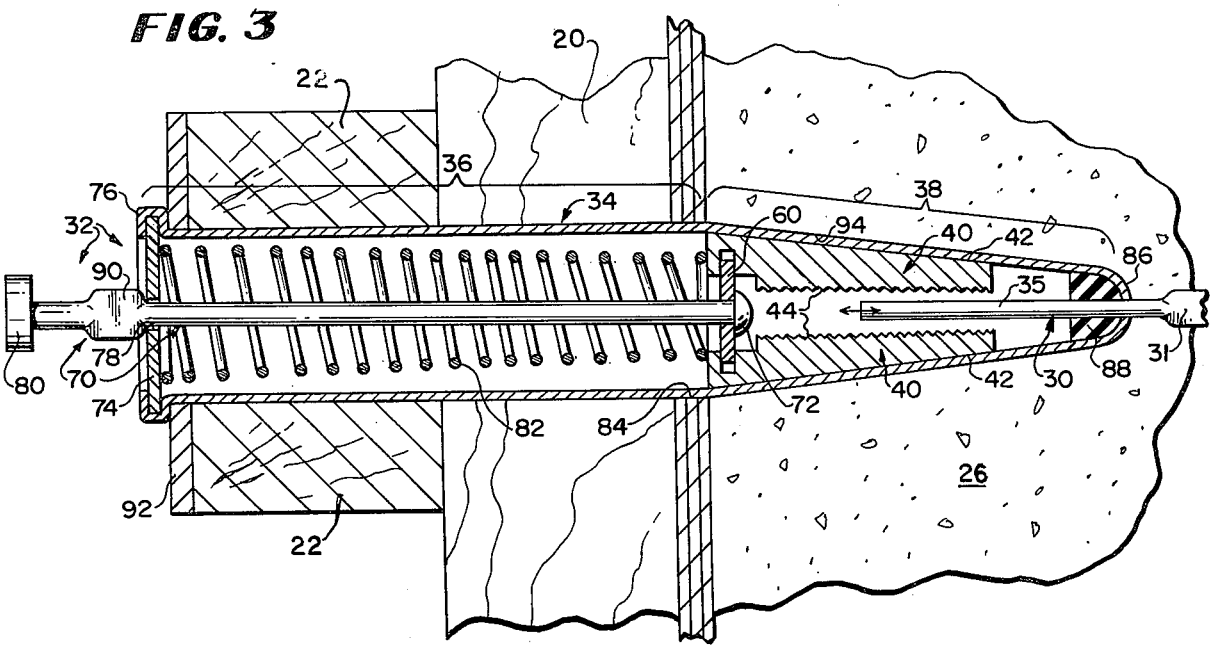
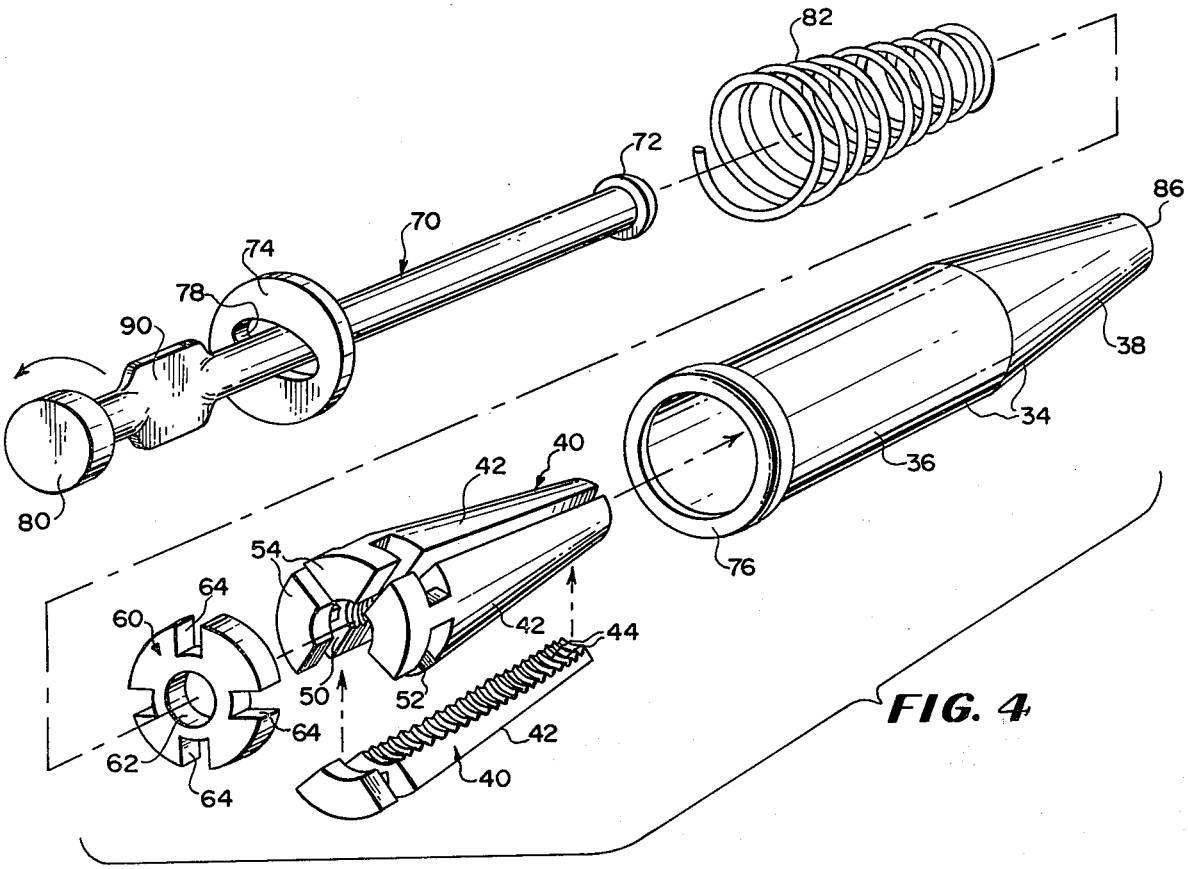
FIG. 4

LATCH-EQUIPPED, SHE-BOLT GRIPPER DEVICE FOR A CONCRETE WALL FROM TIE ROD

The improved, releasable, reusable gripper device comprising the present invention is designed primarily for use as a slip-on she-bolt in connection with a concrete wall or other form where it is telescopically received over one end of a horizontally extending tie rod during concrete-pouring operations between the upstanding, spaced apart sides of the form. The invention is, however, capable of other uses and a gripper device embodying the principles of the invention may, if desired, be employed, either with or without modification as required, for other uses, as, for example, a dead-end anchor device for a tensioned rod-like member, wire or the like, or as a pulling device by means of which tension may be applied to a wire or a rod. Irrespective, however, of the particular use to which the invention may be put, the essential features thereof are at all times preserved.

A gripper device of the general character under consideration consists mainly of a tubular shell which embodies a tapered or frusto-conical forward or inner end section and a cylindrical rearward or outer end section and has within its forward or inner end section a contiguous, circumferentially arranged series of tooth-equipped jaw segments which form a one-way clutch, are slidable lengthwise of the shell, and grip the adjacent end region of the associated tie rod when tension is applied to the rod in one direction. Such a gripper device is not well adapted for use as a she-bolt in connection with concrete formwork unless it is constructed so as to be disposable, inasmuch as to render it reusable, it is necessary to provide a means for releasing the chuck-forming jaw segments which form a part thereof. Furthermore, if such a device projects into the space between the sides of a concrete form where wet concrete is poured for wall-forming purposes, the problem of preventing concrete from seeping into the frusto-conical inner end section of the shell which encloses the chuck-forming jaw segments is difficult to overcome.

Gripper devices of the aforementioned character are widely used in the electrical industry where they are arranged in tandem fashion, i.e., in pairs, and are used as permanent wire splices. They also are made as dead-end devices for stranded wire or cable. Some of these gripper devices are releasable in that when tension in the wire is released, the wire may be shoved rearwardly into the shell of the device in order to back up the pressure of the jaw segments and release the pressure thereof, after which a tool may be introduced laterally through an opening in the side wall of the shell in order to hold the jaw segments released until the wire is drawn from the shell.

One particular gripper device which has been in recent use employs a longitudinally slotted shell through which a radially extending segment-manipulating finger extends so that it is possible collectively to pry or release the jaw segments while the wire is still under tension. Such gripper devices are not well adapted for use as she-bolts in the concrete industry inasmuch as with the slotted type of shell it is impossible to release the tension in the tie rod after the concrete has become hardened. Where a radial finger is used for jaw segment release and the device is used with a concrete wall tie rod, the finger is not always disposed in a convenient place where it is readily accessible for manipulation due to the presence of adjacent obstructions such, for example, as waler boards, strongbacks or nearby concrete wall form hardware such as waler clamps, wedge and bolt fastening devices and the like.

In order to adapt this principle of jaw segment release in a she-bolt type gripper device for particular use in connection with a concrete wall form, there has more recently been developed and currently is in use a she-bolt type gripper device wherein a pull rod extends only a slight distance rearwardly of the rearward or outer end of the tubular shell and is provided on its rear outer end with an enlarged manipulating head which may be either manually engaged or may be pried rearwardly by a suitable tool such as a carpenter's claw hammer for chuck-releasing purposes. Since this head is on the outside of the form, it is readily accessible, and when it is desired to dismantle the associated concrete form, it is merely necessary to pry or otherwise pull or retract the head rearwardly and thus release the chuck-forming jaw segments from the adjacent end of the tie rod, after which the device may be slid bodily as a unit from the tie rod and thereafter it is available for subsequent use in a succeeding concrete wall form installation. A gripper device of this general character forms the subject matter of U.S. Pat. No. 3,910,546, granted on Oct. 7, 1975 in the name of Frank J. Connors, and entitled "SHE-BOLT TYPE GRIPPER DEVICE FOR A CONCRETE WALL FORM TIE ROD."

The present reusable and releasable gripper device is designed as an improvement over the gripper device of aforementioned U.S. Pat. No. 3,910,546 in that it embodies a novel and useful means for releasably locking the pull rod in its retracted position so that it is not necessary to maintain a prying operation upon the pull rod during the time that the device is worked bodily from its bond with the hardened concrete. Stated otherwise, with the earlier she-bolt type gripper device, if a claw hammer is used as a prying tool to draw the pull rod rearwardly, it is necessary to maintain such claw hammer in its prying relationship relative to the pull rod during the entire time that other means are being used to dislodge the device bodily from the cured concrete wall, this presenting an awkward procedure, particularly if a single workman is performing the wall form dismantling operations.

According to the present invention, the over-all general arrangement of the gripper device, including the jaw segments, the segment-biasing spring, the shell for enclosing the jaw segments, and the pull rod which is common to all of the segments remain substantially the same as in the earlier device with the sole exception that the pull rod is "spanked" or otherwise provided with a flattened region which is disposed exterior of but in close proximity to the circular outer end wall of the elongated tubular shell, while said end wall has formed therein a diametrically-extending slot which is commensurate in width and length with the flat or spank on the pull rod. Thus, at such time as it is desired to dismantle the associated concrete wall form, the operator may pry the pull rod rearwardly in the usual manner of operation against the action of the biasing spring and until the spank or flat on the pull rod passes rearwardly or outwardly of the slot in the rear or outer end wall of the shell, after which the operator may turn the pull rod through an angle of the order of 90°, thus causing the flat or spank to extend crosswise of the slot, after which release of the pull rod will allow the spring to force the pull rod forwardly until the flat or spank rests against the edges of the slot. The spank at this time extends crosswise of the slot and is unable to pass through the latter and the pull rod is consequently unable to return to its fully advanced position of jaw segment engagement. The jaw segments are thus maintained in their position of release and the gripper device does not engage the tie rod end region which is projected between such jaw segments.

Actually, in the manufacture and marketing of the aforementioned improved gripper device, the latter may be marketed or packaged for sale with the jaw segments in their retracted position as dictated by the crosswise relationship between the spank or flat and its associated slot in the rear end wall of the shell. Then, when a particular device is initially applied to one end of the associated concrete wall form tie rod, it is merely necessary to apply the device to the tie rod in the usual manner and then twist or turn the pull rod until the spank or flat becomes aligned with the aforementioned elongated slot, whereupon the force of the biasing spring will push the pull rod inwardly of the shell, close the jaw segments on the adjacent tie rod end region, and thus lock the device securely in its operative installed position. A reversal of the process or operation will release the jaw segments from the tie rod as previously described and the device may be left in its original condition, ready for use in a subsequent concrete wall form installation.

The provision of a gripper device such as has briefly been outlined above, and possessing the stated advantages, constitutes the principal object of the present invention.

Numerous other objects and advantages of the invention, not at this time enumerated, will become readily apparent as the nature of the invention is better understood from a consideration of the following detailed description.

The invention consists in the several novel features hereinafter set forth and are more particularly described by the claims at the conclusion hereof.

In the accompanying two sheets of drawings forming a part of this specification, one illustrative embodiment of the invention is shown.

In these drawings:

FIG. 3 is an enlarged longitudinal sectional view taken on the vertical plane indicated by the line 3—3 of FIG. 1 and in the direction of the arrows; and FIG. 4 is an enlarged exploded perspective view of the component parts of the gripper device of FIG. 3.

Figure 1:
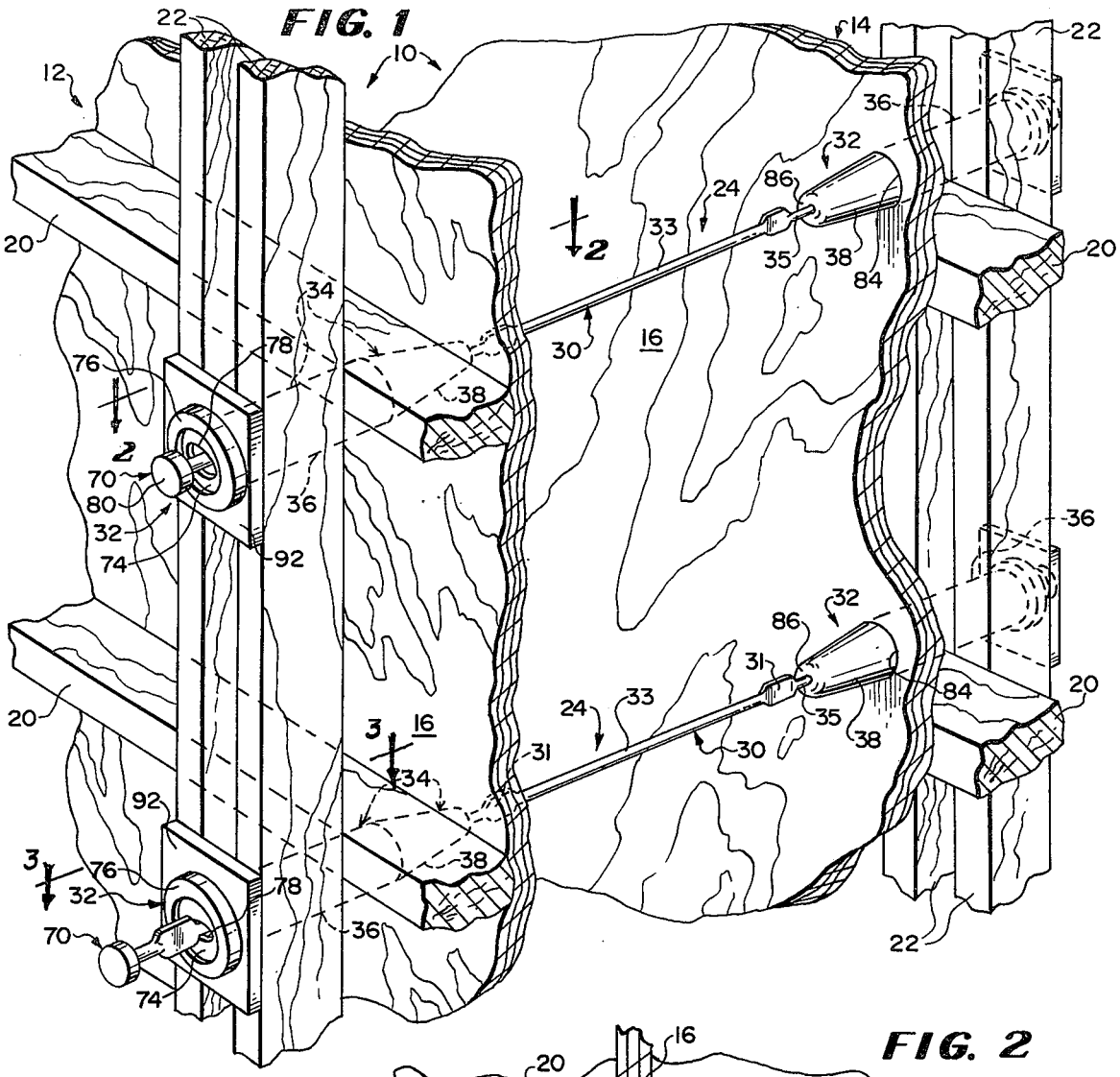
FIG. 1 is a fragmentary perspective view, partly in section, of a concrete wall form, showing at the left-hand side thereof two of the improved gripper devices in use as slip-on she-bolts, one device being illustrated in its position of tie rod release and the other device being shown in its position of tie rod engagement.

Referring now to the drawings in detail and in particular to FIG. 1, a fragmentary portion of a concrete wall form of conventional construction is illustrated therein and is designated in its entirety by the reference numeral 10. The illustrated concrete wall form is of the all-wood type and is made up of two upstanding, spaced apart series 12 and 14 of rectangular, individual plywood panels 16, the panels of each series being arranged in edge-to-edge relationship and so that the two series of panels provide on opposite sides of the form continuous smooth surfaces between which wet concrete is adapted to be poured in the formation of a wall or other concrete structure. In FIG. 1, only two opposed panels are disclosed and these are shown as being backed by horizontal waler boards 20 and vertical strongbacks 22 in a manner well known in the art. The plywood panels 16 of the two series 12 and 14 are maintained in spaced parallel relationship by means of combined spreader and tie rod assemblies 24, two such assemblies being illustrated in FIG. 1 as being associated with two opposed plywood panels 16 of the two series 12 and 14 in the production of a concrete wall 26 (see FIGS. 2 and 3), the wall being omitted in FIG. 1 in the interests of clarity.

Figure 2:
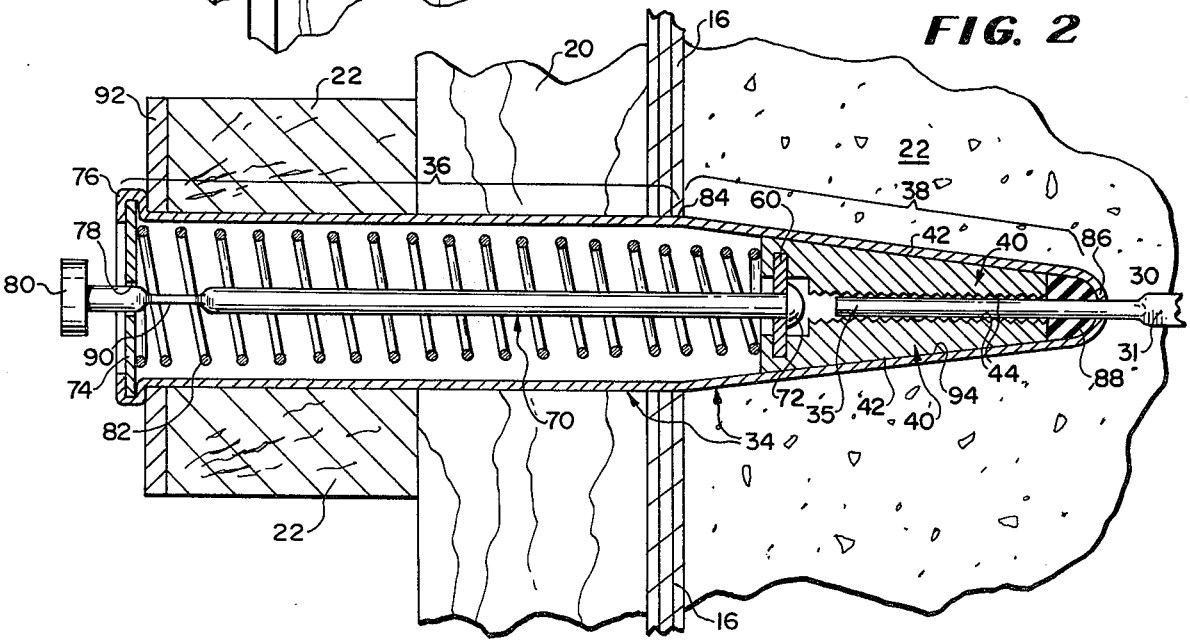
FIG. 2 is an enlarged longitudinal sectional view of one of the improved gripper devices, such view being taken on the vertical plane indicated by the line 2—2 of FIG. 1 and in the direction of the arrows.

Still referring to FIG. 1, and additionally to FIGS. 2 and 3, each combined spreader and tie rod assembly 24 is comprised of a horizontally extending tie rod 30 and a pair of gripper devices which have been designated in their entirety by the reference numeral 32 and the subject matter of which constitutes the principal feature of the present invention. Such gripper devices function in the manner of she-bolts for assimilating the tension in the tie rod 30 at such time as wet concrete is poured between the two side-forming series 12 and 14 of the form. At regions spaced inwardly from the ends of the tie rod 30 and slightly within the confines of the concrete wall form, the tie rod is provided with the usual weakened portions or breakbacks 31, thus dividing the tie rod into a medial section 33 and two end sections 35. The medial section 33 remains embedded within the hardened concrete wall 20 while the end sections 35 normally project through the forward or inner ends of the gripper devices 32 in a manner and for a purpose that will be made clear presently.

Referring now to all of the views of the drawings, each gripper device 32 of each combined spreader and tie rod assembly 24 involves in its general organization an elongated, tubular, metal shell 34 having a rear or outer cylindrical section 36 and a forward or inner frusto-conical section 38. Disposed within the forward frusto-conical section 38 of the shell 34 is a chuck comprising a series of four circumferentially-arranged jaw segments 40, each of which is of elongated tapered design as best shown in FIG. 4. Each jaw segment 40 is provided with a transversely curved or arcuate outer surface 42 which is adapted to slide longitudinally on the inner surface of the forward frusto-conical section 38 of the shell 34, and in addition a transversely curved or arcuate inner tie rod-gripping surface which is in the form of a longitudinal series of teeth 44, the latter extending along a major portion of the length of the segment. Except for the curvature of the aforementioned outer and inner surfaces, each jaw segment 40 is generally trapezoidal in transverse cross section. The various jaw segments are adapted to encompass the adjacent end section 35 of the tie rod 30 when the shell 34 is telescopically projected thereover as shown in FIGS. 2 and 3.

Referring now particularly to FIG. 4, the rear end of each jaw segment 40 is provided with a cutout or recess 50 which establishes a narrow web 52 and an enlarged hook-like head portion 54, the latter constituting, in effect, a longitudinally and rearwardly displaced extension of the main body portion of the segment 40. In the assembled portion of the jaw segments 40 about the adjacent projecting end or section 35 of the associated tie rod 30, the recesses 50 define a complementary sectional void for reception therein of a disk-like pull flange 60 which is in the form of a Maltese Cross and has extending therethrough a central circular opening 62. In the peripheral region of the pull flange 60 there are formed a series of four equidistantly spaced radially and inwardly extending notches 64 which are adapted to receive and interlock with the webs 52 at the rear end regions of the jaw segments 40 in order that the pull flange 60 will be in such fixed interconnected relation with the jaw segments as to cause axial or longitudinal displacement of the segments when the pull flange 60 is pulled rearwardly, while at the same time permitting the segments to move radially within the frusto-conical forward section 38 of the shell 34. An elongated pull rod 70 is disposed in coaxial relationship with the shell 34. The forward end of the pull rod 70 extends through the aforementioned central opening 62 in the pull flange 60 and carries a fixed enlargment 72 which, as shown in FIGS. 2 and 3, abuts against the front end face of said pull flange 60.

The shell 34 of the gripper device 32 is provided with a circular rear end wall 74 and the rear rim 76 of the rear cylindrical section 36 of the shell is beaded over the periphery of such rear end wall 74 in order fixedly to hold the wall in place. The wall 74 is formed with an elongated narrow slot 78 in the central region thereof, the slot being of elliptical configuration and extending diametrically with respect to the end wall. The pull rod 70 projects through such slot and is longitudinally slidable therein. A second and cylindrical enlargement 80 which may be separately manufactured and threaded onto the rear end of the pull rod 70 constitutes a combined torque and pry cap or head, the function of which will be set forth presently. A helical compression spring 82 is disposed within the shell 34 and encompasses the medial region of the pull rod 34, the rear end of the spring bearing against the end wall 74 and the forward end of the spring abutting against the rear end faces of the hook-like head portions 54 of the segments 40. At such time as the jaw segments 40 are pulled rearwardly by exerting a pulling force either manually or by means of a prying tool at the rear end of the pull rod 70, such segments move radially outwardly and assume an expanded position wherein they are withdrawn from their gripping relation with the adjacent end section or region of the tie rod 30. However, when no rearward force is exerted on the pull rod, the helical compression spring 82 serves to urge the jaw segments 40 forwardly so that they are contracted by the camming action of the inside face of the forward frusto-conical section 38 of the shell 34 into firm gripping relationship with the adjacent end section 35 of the tie rod 30.

It is to be noted at this point from an inspection of FIGS. 2 and 3 that the forward frusto-conical section 38 of the gripper shell 34 projects through an opening 84 in the associated plywood panel 16 and is embedded in the concrete of the poured concrete of the wall 26. It is thus necessary to seal such forward end section of the shell against the entrance of wet concrete at the time of concrete pouring. Accordingly, the forward frusto-conical section 38 of the shell 34 has its forward end cupped inwardly as indicated at 86 so as, in effect, to define a front wall for the shell. Seated within such cupped portion of the shell and forwardly of the four jaw segments 40 is a doughnut-like elastomeric sealing ring 88 through which the adjacent end portion of the tie rod extends slidingly.

The present invention is predicated upon the provision of a means for releasably latching the pull rod 70 in a retracted position such as that in which it is shown in the lower left-hand portion of FIG. 1 and also in FIG. 3 of the drawings. The gripper device 32 is capable of assuming such latched condition either in its free state apart from its association with the concrete wall form 10 or when it is operatively installed in the form. Accordingly and as best shown in FIG. 4, the pull rod 70 is provided at a region closely adjacent to the cylindrical enlargement 80 with a flattened region or area 90 which in the art of tie rod and other cylindrical rod formation is commonly referred to as a "flat" or a "spank." The thickness and width of the spank 90 are such that when such spank is aligned with the generally elliptical slot 78 in the rear end wall 74 of the gripper shell 34, such spank may pass through the slot, but when the spank is not aligned with the slot, it is incapable of passing therethrough. The disposition of the spank 90 on the pull rod 70 is such that when the former is disposed within the confines of the shell 34, the spring 82 maintains the four jaw segments 40 in their closed position for tie rod gripping purposes and when the spank 90 is disposed rearwardly and outside of the shell 34, the spank 90 latches against the side edges of the slot 78 as shown in the lower left-hand portion of FIG. 1 and also in FIG. 3 to the end that the jaw segments 40 remain in their retracted open position against the action of the spring 82.

In the installation of the herein described she-bolt type gripper device 32 over the adjacent outwardly projecting end section 35 of the tie rod 30, a rectangular seating plate 92 is telescopically inserted over the shell and the device 32 is then projected between a pair of the adjacent vertical strongbacks 22 and caused to extend through the associated opening in the adjacent plywood panel 16 as clearly shown in FIGS. 1 and 3. It will be understood, of course, that prior to such insertion of the gripper device 32, care will be taken to assure the fact that the pull rod has been moved to its latched retracted position as previously described. With the jaw segments 40 thus held in their open position, it is a comparatively easy matter for a workman to guide the adjacent outer end section 35 of the tie rod 30 through the open cupped end 86 of the frusto-conical section 38 of the shell 34, after which the cylindrical enlargement 80 on the outer end of the pull rod 70 may be turned throughout an angle of 90° and then released so as to allow the spank 90 to pass inwardly through the slot 78 in the rear end wall 74 of the shell 34, thereby resulting in the jaw segments 30 to close upon the tie rod under the impelling influence of the helical spring 82. With the tie rod 30 thus gripped by the gripper device 32, the latter then functions in the manner of a shel-bolt and constitutes an element of concrete form hardware in the concrete wall form 10.

Concrete form dismantling operations are readily carried out by the simple expedient of pulling the pull rod 70 rearwardly so that the flattened area or spank 90 passes rearwardly and outwardly of the shell 34 through the elliptical slot 78 in the rear wall 74 of the shell. Such rearward movement, of course, causes the jaw segments 40 to be released from the projecting adjacent end section 35 of the tie rod 30. After the spank 90 has reached a position wherein it lies outside the confines of the shell 34, the operator will rotate the cylindrical enlargement 80 throughout an angle of approximately 90° and then release the same, whereupon the spring 82 will urge the various jaw segments 40 forwardly, thus pulling the pull rod 70 forwardly until the spank 90 assumes its latched engagement with the side edge regions of the elliptical slot 78 in the rear wall of the shell 34 as previously described. At this moment, however, the forward displacement of the pull rod 70 will not be so great as to allow the jaw segments 40 to close upon the adjacent end region or section 35 of the tie rod and the latter will thus be freed from the gripper device 32 as a whole, whereupon the entire gripper device may be pulled rearwardly and withdrawn from the frusto-conical socket 94 (see FIG. 3) which becomes established in the concrete wall 26 by reason of the partial embedment of the frusto-conical section 34 or nose portion of the gripper shell 34.

It is to be particularly noted that rearward pulling of the pull rod 70 may sometimes be accomplished by manual force, but in the event that this proves difficult, a suitable tool such as a conventional carpenter's claw hammer may be employed for a prying operation by inserting the claw portion of such tool between the cylindrical enlargement 80 and the rectangular seating plate 92. After any given collapse of the jaw segments 40 upon the adjacent end section 35 of the associated tie rod 30, the angularity of the spank 90 with respect to the elliptical slot 78 in the rear end wall 74 of the shell 32 is unlikely to become disturbed due to the inherent friction of the parts which are concerned. Therefore, it is seldom necessary for the operator to "fish" for accurate alignment of the spank 90 and opening 78 and a direct pull rearwardly on the pull rod 70 will practically invariably result in pulling the spank 90 rearwardly and outwardly of the shell 34 through such opening 78. Turning of the spank 90 so that it becomes misaligned with the axis of the elliptical opening 78 for latching purposes as previously described presents no problem inasmuch as a twist of the claw hammer ordinarily will result in a corresponding turning movement of the pull rod. If not, then the use of a pair of pliers or other torque tool on the spank 90 itself will suffice.

The invention is not to be limited to the exact arrangement of parts shown in the accompanying drawings or described in this specification as various changes in the details of construction may be resorted to without departing from the spirit or scope of the invention. For example, although the opening 78 in the rear end wall 74 has been illustrated and described herein as being of elliptical contour with a relatively long major axis and a relatively short minor axis, while the flattened spank 90 is shown as being substantially planar, it is within the purview of the invention to employ various other non-circular openings 78 and to design the spank 90 so that it will pass through such opening in one or more angular positions and fail to pass through the opening when turned so that it no longer mates with the opening. Furthermore, whereas the rectangular seating plate 92 is shown and described as being manufactured separately from the shell 34, it is contemplated that such plate may be formed integrally with the shell and assume the form of a radial flange. Therefore, only insofar as the invention is particularly pointed out in the accompanying claims is the same to be limited.

Having thus described the invention, what I claim as new and desire to secure by Letters Patent is:

1. A gripper device adapted for application to one end of a cylindrical rod and comprising an open-ended, tapered, tubular shell having a frusto-conical front end section and a cylindrical rear end section and embodying wall extending across the rear end of said rear section, a plurality of tapered, tooth-equipped jaw segments slidably disposed within the front end section of said shell in circumferentially arranged relationship and defining a chuck structure for reception of said one end of the rod when it is projected into the front end section of the shell, a compression spring disposed between said wall and jaw segments and effective to bias the latter forwardly in the shell in camming relationship with respect to the tapered wall of the front end section of the shell and thus forcibly collapse said segments into gripping engagement with said one end of the rod, said wall having formed therein a central opening of non-circular configuration, and a pull rod projecting centrally and slidably through said opening, extending in coaxial relation with the shell, rotatable about the longitudinal access of the shell, having its forward end operatively connected in common to the rear ends of said jaw segments, and effective when it is shifted rearwardly against the biasing action of the spring to release said segments from said one end of the rod, and releasable latch means on said pull rod, normally disposed within the confines of the shell, and movable bodily with the pull rod rearwardly through said central opening to a retracted position exteriorly of the shell, said latch means being effective when the pull rod is released to make latching engagement with the edge region of said opening and thus maintain the pull rod in its retracted position, said latch means also being in the form of an enlargement which is formed on the rod, has a cross-sectional shape commensurate to said central non-circular opening, is, in at least one rotational position of the pull rod, capable of passing through said opening, and is, in at least one other rotational position of the pull rod, incapable of passing through said opening.

2. A gripper device as set forth in claim 1 and wherein said pull rod is formed of cylindrical rod stock, the central opening in the wall is in the form of an elongated narrow slot of a width slightly larger than the diameter of the pull rod, and the enlargement of the latch means is in the form of a flat spank having a transverse width greater than the transverse width of said slot and less than the longitudinal extent of such slot whereby it is capable of passing through said slot in either of two rotational positions of the pull rod which are 180° apart.

3. A gripper device as set forth in claim 2 and wherein the central opening in the wall is elliptical in contour.

4. A gripper device designed for use as a she-bolt in gripping the projecting end of a concrete-embedded tie rod in associated relation with a concrete wall form, said device comprising a generally tapered tubular shell of circular cross section and having a small front end section and a large rear end section, a plurality of correspondingly tapered, tooth-equipped jaw segments slidably disposed within the small end section of the shell in circumferentially arranged relationship and defining a chuck structure for reception of said tie rod end, a rear circular wall extending across and fixedly connected to the rear end section of said shell, a compression spring interposed between said wall and jaw segments and effective to bias the latter forwardly in the shell in camming relationship with respect to the tapered wall of the shell and thus forcibly collapse said segments into gripping engagement with said one end of the tie rod, a front annular wall extending across the front end of the shell and through which the projecting end of the tie rod is adapted to extend, an elastomeric sealing ring interposed between the forward ends of said jaw segments and said front annular wall, said rear circular wall being provided with a narrow slot in the central region thereof, a cylindrical rotatable pull rod projecting through said slot and extending coaxially with respect to the shell, and means operatively connecting the rear end of the pull rod in common to the rear ends of said chuck segments while allowing for rotation of the pull rod so that in any rotational position of the pull rod rearward movement of the latter will effect rearward movement of the jaw segments collectively and thus release the latter from their gripping engagement with the tie rod, said pull rod being provided with a flat latching spank having a transverse width greater than the transverse width of said slot and less than the longitudinal extent of such slot, said spank being normally disposed within the confines of the shell and being movable bodily with the pull rod rearwardly through said elongated slot to a position exteriorly of the shell and rearwardly of said wall when the angular position of the pull rod is such that the spank and slot are substantially in directional register, said spank and slot cooperating with each other to prevent return forward movement of the spank into the confines of the shell when the pull rod is rotated to an angular position wherein the spank and slot are out of directional register.

5. A gripper device as set forth in claim 4 and wherein said slot is provided with an elliptical contour having a relatively long major axis and a relatively short minor axis.

6. A gripper device as set forth in claim 5 and wherein the rear end of said pull rod is provided with an enlarged combined torque and pry head.

* * * * *